US009476107B2

(12) United States Patent
Bramfitt et al.

(10) Patent No.: US 9,476,107 B2
(45) Date of Patent: Oct. 25, 2016

(54) METHOD OF MAKING HIGH STRENGTH STEEL CRANE RAIL

(71) Applicant: Arcelormittal Investigación y Desarrollo SL, Sestao, Bizkaia (ES)

(72) Inventors: Bruce L. Bramfitt, Bethlehem, PA (US); Frederick B. Fletcher, Wayne, PA (US); Jason T McCullough, Hummelstown, PA (US); Michael A. Muscarella, Mechanicsburg, PA (US); John S. Nelson, Harrisburg, PA (US)

(73) Assignee: Arcelormittal, Luxembourg (LU)

( * ) Notice: Subject to any disclaimer, the term of this patent is extended or adjusted under 35 U.S.C. 154(b) by 0 days.

(21) Appl. No.: 14/081,581

(22) Filed: Nov. 15, 2013

(65) Prior Publication Data

US 2014/0130943 A1 May 15, 2014

Related U.S. Application Data

(60) Provisional application No. 61/726,945, filed on Nov. 15, 2012.

(51) Int. Cl.

| | |
|---|---|
| ***C21D 9/04*** | (2006.01) |
| ***C22C 38/04*** | (2006.01) |
| ***C22C 38/14*** | (2006.01) |

(52) U.S. Cl.

CPC ..... *C21D 9/04* (2013.01); *C22C 38/04* (2013.01); *C22C 38/14* (2013.01)

(58) Field of Classification Search

CPC ..... C21D 9/04; C22C 38/04; C22C 38/14

See application file for complete search history.

(56) References Cited

U.S. PATENT DOCUMENTS

| | | | | |
|---|---|---|---|---|
| 3,193,270 | A * | 7/1965 | Dewez, Jr. | C21D 9/06 148/585 |
| 4,486,248 | A | 12/1984 | Ackert et al. | |
| 5,658,400 | A | 8/1997 | Uchino et al. | |
| 8,241,442 | B2 * | 8/2012 | Bramfitt | C21D 9/04 148/569 |
| 8,388,775 | B2 | 3/2013 | Poloni et al. | |
| 9,157,131 | B2 | 10/2015 | Zou et al. | |

FOREIGN PATENT DOCUMENTS

| | | | | |
|---|---|---|---|---|
| CN | 101868557 | | 10/2010 | |
| CN | 102220545 | | 10/2011 | |
| EP | 1 493 831 | * | 1/2005 | C21D 9/04 |
| JP | H082137 | | 1/1994 | |
| JP | 2000178690 | | 6/2000 | |
| WO | WO9517532 | | 6/1995 | |

* cited by examiner

*Primary Examiner* — Jessee Roe

(74) *Attorney, Agent, or Firm* — David W. Shumaker

(57) ABSTRACT

A method of making a high strength head-hardened crane rail and the crane rail produced by the method. The method comprises the steps of providing a steel rail having a composition comprising, in weight percent: C 0.79-1.00%; Mn 0.40-1.00; Si 0.30-1.00; Cr 0.20-1.00; V 0.05-0.35; Ti 0.01-0.035; N 0.002 to 0.0150; and the remainder being predominantly iron. The steel rail is cooled from a temperature between about 700 and 800° C. at a cooling rate having an upper cooling rate boundary plot defined by an upper line connecting xy-coordinates (0 s, 800° C.), (40 s, 700° C.), and (140 s, 600° C.) and a lower cooling rate boundary plot defined by a lower line connecting xy-coordinates (0 s, 700° C.), (40 s, 600° C.), and (140 s, 500° C.).

19 Claims, 6 Drawing Sheets

METHOD OF MAKING HIGH STRENGTH STEEL CRANE RAIL

CROSS-REFERENCE TO RELATED APPLICATIONS

This Application claims the benefit under 35 U.S.C. 119(e) of U.S. Provisional Application No. 61/726,945 filed Nov. 15, 2012.

FIELD OF THE INVENTION

The present invention relates to steel rails and more particularly to crane rails. Specifically the present invention relates to very high hardness steel crane rails and a method of production thereof.

BACKGROUND OF THE INVENTION

Cranes that move on steel rails installed on the ground or on elevated runways are used to transport objects and materials from one location to another. Examples include industrial buildings (steel mills) and ports where ships are unloaded and goods are placed on transport vehicles. The rails are called crane rails and are required to safely support heavy loads while maintaining a low maintenance, extended life cycle. Compared to the common "Tee-rails" used for railroads and light rail transit lines, crane rails typically have significantly more massive head sections and thicker web sections.

As loads have increased over the years, the crane rail must resist plastic deformation and damage. The current trend is that the crane rail must have higher hardness and high strength to resist damage. A typical industrial crane (steel mill) has eight wheels, 60-70 cm in diameter with wheel loads up to 60 tons. The point of actual contact between a steel crane rail and the crane wheel is quite small and usually concentrated in the center of the crane rail head. Since both the rail and wheel are at a high level of compression; very large localized stresses result. Recently many cranes have switched to harder wheels to extend wheel life and to lower maintenance costs. The moving crane and the accompanying shock loads can result in fatigue damage to the crane rail, the wheel and the supporting girder system. Crane rails are also subject to head wear and are routinely inspected to determine that the amount of wear is still acceptable for continued use. It is necessary to replace the crane rail when it suffers mushrooming or non-symmetrical deformation and wear.

Based on increasing crane loads and higher hardness crane wheels, the crane rail technical requirements in general are shifting to higher hardness, higher strength steel grades. Because of the limited size of the crane rail market, there are few steel mills that produce crane rails, leaving customers in a difficult situation.

The ArcelorMittal Steelton plant is the major producer of crane rails in the Western Hemisphere and has utilized its rail head hardening facility to produce a higher hardness crane rail by accelerated cooling directly off the rail mill. However, customers are requesting even higher hardness crane rail for heavy load applications than are available from conventional rail steel compositions. There is a need in the art for a high hardness crane rail having a higher hardness than is presently conventionally available.

SUMMARY OF THE INVENTION

The present invention relates to a method of making a high strength head-hardened crane rail and the crane rail produced by the method. The method comprises the steps of providing a steel rail having a composition comprising, in weight percent: carbon 0.79-1.00%; manganese 0.40-1.00; silicon 0.30-1.00; chromium 0.20-1.00; vanadium 0.05-0.35; titanium 0.01-0.035; nitrogen 0.002 to 0.0150; and the remainder being predominantly iron. The steel rail provided at a temperature between about 700 and 800° C. The method comprises the further step of cooling said steel rail at a cooling rate that, if plotted on a graph with xy-coordinates with the x-axis representing cooling time in seconds and the y-axis representing temperature in ° C. of the surface of the head of the steel rail, is maintained in a region between an upper cooling rate boundary plot defined by an upper line connecting xy-coordinates (0 s, 800° C.), (40 s, 700° C.), and (140 s, 600° C.) and a lower cooling rate boundary plot defined by a lower line connecting xy-coordinates (0 s, 700° C.), (40 s, 600° C.), and (140 s, 500° C.).

The steel rail composition may preferably comprise, in weight percent: carbon 0.8-0.9; manganese 0.7-0.8; silicon 0.5-0.6; chromium 0.2-0.3; vanadium 0.05-0.1; titanium 0.02-0.03; nitrogen 0.008-0.01; and the remainder being predominantly iron. The steel rail composition may more preferably comprise, in weight percent: carbon 0.87; manganese 0.76; silicon 0.54; chromium 0.24; vanadium 0.089; titanium 0.024; phosphorus 0.011; sulfur 0.006; nitrogen 0.009; and the remainder being predominantly iron.

The crane rail has a head portion that may have a fully pearlitic microstructure. The head of said crane rail may have an average Brinell hardness of at least 370 HB at a depth of ⅜ inches from the top center of said crane rail head; at least 370 HB at a depth of ⅜ inches from the sides of said crane rail head; and at least 340 HB at a depth of ¾ inches from the top center of said crane rail head. The crane rail may have a yield strength of at least 120 ksi; an ultimate tensile strength of at least 180 ksi, a total elongation of at least 8% and a reduction in area of at least 20%.

The cooling rate from 0 second to 20 seconds plotted on the graph may have an average within a range of between about 2.25° C./sec and 5° C./sec, and wherein the cooling rate from 20 seconds to 140 seconds plotted on the graph may have an average within a range of between about 1° C./sec and 1.5° C./sec.

The step of providing a steel rail may comprise the steps of: forming a steel melt at a temperature of about 1600° C. to about 1650° C. by sequentially adding manganese, silicon, carbon, chromium, followed by titanium and vanadium in any order or in combination to form the melt; vacuum degassing said melt to further remove oxygen, hydrogen and other potentially harmful gases; casting said melt into blooms; heating the cast blooms to about 1220° C.; rolling said bloom into a "rolled" bloom employing a plurality of passes on a blooming mill; placing said rolled blooms into a reheat furnace; re-heating said rolled blooms to 1220° C. to provide a uniform rail rolling temperature; descaling said rolled bloom; passing said rolled bloom sequentially through a roughing mill, intermediate roughing mill and a finishing mill to create a finished steel rail, said finishing mill having an output finishing temperature of 1040° C.; descaling said finished steel rail at above 900° C. to obtain a uniform secondary oxide on said; and air cooling said finished rail to about 700° C.-800° C.

The step of cooling said steel rail may comprise cooling said rail with water for 140 seconds. The step of cooling said steel rail with water may comprise cooling said steel rail with spray jets of water. The water comprising said spray jets of water may be maintained at a temperature of between 10-16° C. The step of cooling said steel rail with spray jets of water may comprise directing said jets of water at the top of the rail head, the sides of the rail head, the sides of the rail web and the foot of the rail. The step of cooling said steel rail with spray jets of water may comprise passing said steel rail through a cooling chamber which includes said spray jets of water. The cooling chamber may comprise four sections and the water flow rate in each section may be varied depending on the cooling requirement in each of the sections. The greatest amount of water may be applied in the first/inlet section of said cooling chamber, creating a cooling rate fast enough to suppress the formation of proeutectoid cementite and initiate the start of the pearlite transformation below 700° C. The water flow rate in the first/inlet section of the cooling chamber may be 25 $m^3$/hr, the water flow rate in the second section of the cooling chamber may be 21 $m^3$/hr, the water flow rate in the third section of the cooling chamber may be 9 $m^3$/hr; and the water flow rate in the fourth/last section of the cooling chamber may be 10 $m^3$/hr.

The step of cooling said steel rail may further comprise the step of cooling said rail in air to ambient temperature after said step of cooling said rail with water for 140 seconds.

DETAILED DESCRIPTION OF THE INVENTION

The present invention involves a combination of steel composition and accelerated cooling to produce a crane rail of superior hardness and strength.

Current Specifications:

The standard specification for crane rails is ASTM A759 "Carbon Steel Crane Rails". The composition limits are (in weight %): Carbon 0.67-0.84%; Manganese 0.70-1.10%; Silicon 0.10-0.50%; Phosphorus 0.04% max; Sulfur 0.05% max. Although, the microstructure is not specified in ASTM A759, crane rails made from this composition exhibit a pearlitic microstructure when control-cooled on a cooling bed or accelerated-cooled.

Figure 1:
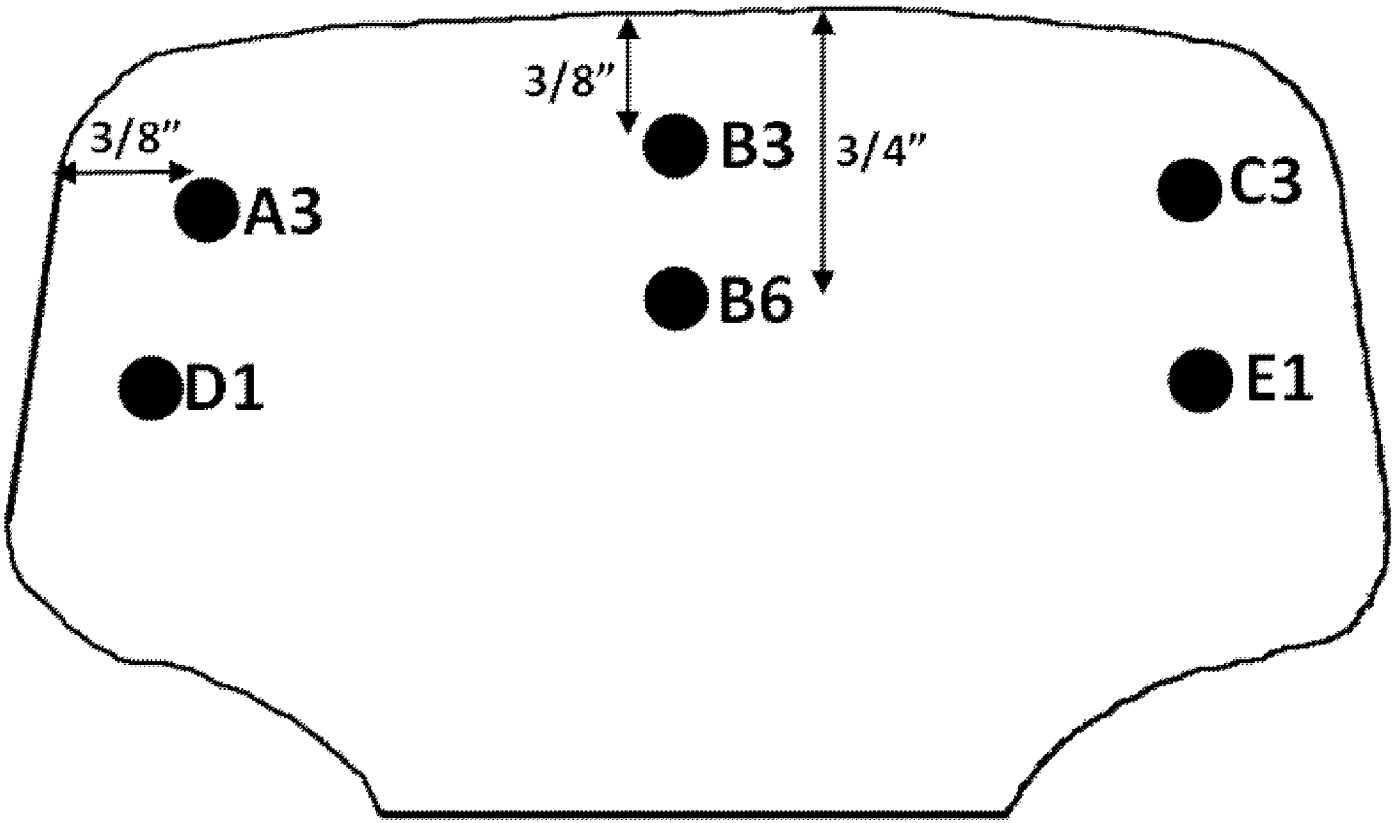
FIG. 1 is a schematic cross section of the head portion of a crane rail denoting locations on the crane rail head which will be averaged to determine hardness of the crane rail head.

Progression of Crane Rail Composition and Hardness:

For years, crane rail composition consisted of the simple C—Mn—Si chemistry shown above. However, different grades of crane rail have been developed in order to increase hardness properties. Hardness is the primary property requirement specified in crane rail. FIG. 1 is a schematic cross section of the head portion of a crane rail. The present inventors use the pattern shown in FIG. 1 for the Brinell hardness measurements in the crane rail head (175 lb/yd). Locations A3, B3 and C3 on the crane rail head will be averaged and called top head hardness. Locations D1 and E1 on the crane rail head will be averaged and called side head hardness and location B6 on the crane rail head will be called center head hardness.

Crane Rail Grades:

Three existing prior art crane rail grades and the inventive grade (coded INV) are described below.

Control-Cooled (CC) Crane Rail:

The C—Mn—Si rails are rolled on a rail mill and are simply air-cooled on a cooling bed. This grade is called control-cooled (CC) crane rail. Representative compositions of CC crane rails are listed in Table 1.

TABLE 1

| Type | Heat | C | Mn | P | S | Si | Cr | V | Ti | N |
|---|---|---|---|---|---|---|---|---|---|---|
| CC | 207S385 | 0.79 | 0.83 | 0.010 | 0.014 | 0.20 | 0.09 | 0.001 | 0.003 | 0.0089 |
| CC | 207S386 | 0.80 | 0.83 | 0.011 | 0.012 | 0.20 | 0.11 | 0.001 | 0.004 | 0.0092 |
| CC | 207S387 | 0.80 | 0.82 | 0.011 | 0.012 | 0.18 | 0.11 | 0.001 | 0.003 | 0.0084 |

The carbon content is at the eutectoid point of the iron-carbon binary diagram and the resulting microstructure is 100% pearlite.

Head-Hardened (HH) Crane Rail:

The next crane rail development in the 1990's was to accelerate-cool crane rails made from a basic C—Mn—Si steel to achieve higher hardness by developing a finer pearlite interlamellar spacing. Compared to the steel used for CC rails, the steel for HH rails contains more Mn, Si and Cr. The accelerated cooling process is called head hardening. Representative compositions of head-hardened (HH) crane rail are shown in Table 2. This table represents three heats of crane rail where the carbon ranges from 0.80-0.82%, Mn from 0.96-0.99%, Si from 0.40-0.44% and Cr from 0.20-0.21%.

TABLE 2

| Type | Heat | C | Mn | P | S | Si | Cr | V | Ti | N |
|---|---|---|---|---|---|---|---|---|---|---|
| HH | 217S311 | 0.82 | 0.96 | 0.013 | 0.008 | 0.40 | 0.20 | 0.001 | 0.006 | 0.0084 |
| HH | 217S350 | 0.80 | 0.98 | 0.012 | 0.011 | 0.44 | 0.20 | 0.001 | 0.004 | 0.0128 |
| HH | 217S347 | 0.81 | 0.99 | 0.012 | 0.008 | 0.41 | 0.21 | 0.001 | 0.005 | 0.0107 |

High Carbon (HC) crane rail: In order to achieve an even higher hardness, the carbon level of the above HH steel was increased from 0.80-0.82%C to 0.88-0.90%C and the crane rails rolled from this composition are also head-hardened. Representative compositions of head-hardened HC crane rail are shown in Table 3.

At a higher carbon level, these rails are at the hypereutectoid side of the iron-carbon binary eutectic point. This means that there is a possibility to form proeutectoid cementite networks on the prior austenite grain boundaries. If these networks are present, the ductility will be lower. However, accelerated cooling will help to minimize network formation.

TABLE 3

| Type | Heat | C | Mn | P | S | Si | Cr | V | Ti | N |
|---|---|---|---|---|---|---|---|---|---|---|
| HC | 217S364 | 0.88 | 1.02 | 0.010 | 0.008 | 0.38 | 0.21 | 0.001 | 0.003 | 0.0088 |
| HC | 217S365 | 0.89 | 1.02 | 0.010 | 0.010 | 0.41 | 0.20 | 0.001 | 0.002 | 0.0094 |
| HC | 217S366 | 0.90 | 1.03 | 0.010 | 0.008 | 0.44 | 0.20 | 0.001 | 0.004 | 0.0081 |

High hardness and high strength crane rail trial: To achieve even higher hardness and strength than HC crane rail without sacrificing ductility, the present inventors have conducted trials of a new higher hardness crane rail with a modified composition combined with specifically modified head hardening parameters. The inventive (INV) grade involves a head-hardened crane rail steel with lower Mn and higher Si and Cr. Important microalloying elements titanium and vanadium are also added. The composition used in the trial is shown in Table 4 in weight percent (iron is the remainder).

TABLE 4

| Type | Heat | C | Mn | P | S | Si | Cr | V | Ti | N |
|---|---|---|---|---|---|---|---|---|---|---|
| INV | 270S009 | 0.87 | 0.76 | 0.011 | 0.006 | 0.54 | 0.24 | 0.089 | 0.024 | 0.0090 |

The high strength steel crane rail of the present invention has a pearlitic microstructure and generally, the following composition in weight %, with iron being the substantial remainder:

Carbon 0.79-1.00 (preferably 0.8-0.9)
Manganese 0.40-1.00 (preferably 0.7-0.8)
Silicon 0.30-1.00 (preferably 0.5-0.6)
Chromium 0.20-1.00 (preferably 0.2-0.3)
Vanadium 0.05-0.35 (preferably 0.05-0.1)
Titanium 0.01-0.035 (preferably 0.02-0.03)
Nitrogen 0.002-0.0150 (preferably 0.008-0.01)

Carbon is essential to achieve high strength rail properties. Carbon combines with iron to form iron carbide (cementite). The iron carbide contributes to high hardness and imparts high strength to rail steel. With high carbon content (above about 0.8 wt % C, optionally above 0.9 wt %) a higher volume fraction of iron carbide (cementite) continues to form above that of conventional eutectoid (pearlitic) steel.

One way to utilize the higher carbon content in the new steel is by accelerated cooling (head hardening) and suppressing the formation of harmful proeutectoid cementite networks on austenite grain boundaries. As discussed below, the higher carbon level also avoids the formation of soft ferrite at the rail surface by normal decarburization. In other words, the steel has sufficient carbon to prevent the surface of the steel from becoming hypoeutectoid. Carbon levels greater than 1 wt % can create undesirable cementite networks.

Manganese is a deoxidizer of the liquid steel and is added to tie-up sulfur in the form of manganese sulfides, thus preventing the formation of iron sulfides that are brittle and deleterious to hot ductility. Manganese also contributes to hardness and strength of the pearlite by retarding the pearlite transformation nucleation, thereby lowering the transformation temperature and decreasing interlamellar pearlite spacing. High levels of manganese (e.g., above 1%) can generate undesirable internal segregation during solidification and microstructures that degrade properties. In exemplary embodiments, manganese is lowered from a conventional head-hardened steel composition level to shift the "nose" of the continuous cooling transformation (CCT) diagram to shorter times i.e. the curve is shifted to the left. Generally, more pearlite and lower transformation products (e.g., bainite) form near the "nose." In accordance with exemplary embodiments, the initial cooling rate is accelerated to take advantage of this shift, the cooling rates are accelerated to form the pearlite near the nose. Operating the head-hardening process at higher cooling rates promotes a finer (and harder) pearlitic microstructure. However, when operating at higher cooling rates there are occasional problems with heat transfer instability where the rail overcools and is rendered unsatisfactory due to the presence of bainite or martensite. With the inventive composition, head hardening can be conducted at higher cooling rates without the occurrence of instability. Therefore, manganese is kept below 1% to decrease segregation and prevent undesired microstructures. The manganese level is preferably maintained above about 0.40 wt % to tie up the sulfur through the formation of manganese sulfide. High sulfur contents can create high levels of iron sulfide and lead to increased brittleness.

Silicon is another deoxidizer of the liquid steel and is a powerful solid solution strengthener of the ferrite phase in the pearlite (silicon does not combine with cementite). Silicon also suppresses the formation of continuous proeutectoid cementite networks on the prior austenite grain boundaries by altering the activity of carbon in the austenite. Silicon is preferably present at a level of at least about 0.3 wt % to prevent cementite network formation, and at a level not greater than 1.0 wt % to avoid embrittlement during hot rolling.

Chromium provides solid solution strengthening in both the ferrite and cementite phases of pearlite.

Vanadium combines with excess carbon and nitrogen to form vanadium carbide (carbonitride) during transformation for improving hardness and strengthening the ferrite phase in pearlite. The vanadium effectively competes with the iron for carbon, thereby preventing the formation of continuous cementite networks. The vanadium carbide refines the austenitic grain size, and acts to break-up the formation continuous pro-eutectoid cementite networks at austenite grain boundaries, particularly in the presence of the levels of silicon practiced by the present invention. Vanadium levels below 0.05 wt % produce insufficient vanadium carbide precipitates to suppress the continuous cementite networks. Levels above 0.35 wt % can be harmful to the elongation properties of the steel.

Titanium combines with nitrogen to form titanium nitride precipitates that pin the austenite grain boundaries during heating and rolling of the steel thereby preventing excessive austenitic grain growth. This grain refinement is important to restricting austenite grain growth during heating and rolling of the rails at finishing temperatures above 900° C. Grain refinement provides a good combination of ductility and strength. Titanium levels above 0.01 wt % are favorable to tensile elongation, producing elongation values over 8%, such as 8-12%. Titanium levels below 0.01 wt % can reduce the elongation average to below 8%. Titanium levels above 0.035 wt % can produce large TiN particles that are ineffectual for restricting austenite grain growth.

Nitrogen is important to combine with the titanium to form TiN precipitates. A naturally occurring amount of nitrogen impurity is typically present in the electric furnace melting process. It may be desirable to add additional nitrogen to the composition to bring the nitrogen level to above 0.002 wt ° A), which is typically a sufficient nitrogen level to allow nitrogen to combine with titanium to form titanium nitride precipitates. Generally, nitrogen levels higher than 0.0150 wt % are not necessary.

The carbon level is essentially the same as the high carbon (HC) crane rail grade. The composition is hypereutectoid with a higher volume fraction of cementite for added hardness. The manganese is purposely reduced to prevent lower transformation products (bainite and martensite) from forming when the crane rails are welded. The silicon level is increased to provide higher hardness and to help to suppress the formation of proeutectoid cementite networks at the prior austenite grain boundaries. The slightly higher chromium is for added higher hardness. The titanium addition combines with nitrogen to form submicroscopic titanium nitride particles that precipitate in the austenite phase. These TiN particles pin the austenite grain boundaries during the heating cycle to prevent grain growth resulting in a finer austenitic grain size. The vanadium addition combines with carbon to form submicroscopic vanadium carbide particles that precipitate during the pearlite transformation and results in a strong hardening effect. Vanadium along with the silicon addition and accelerated cooling suppresses the formation of proeutectoid cementite networks.

Hardness properties: The average Brinell hardness of the three conventional grades and the invention grade are shown in Table 5.

TABLE 5

| Type | Top | Sides | Center |
|---|---|---|---|
| CC | 308 | 307 | 302 |
| HH | 338 | 346 | 315 |
| HC | 362 | 372 | 337 |
| INV | 371 | 378 | 346 |

Figure 2A:
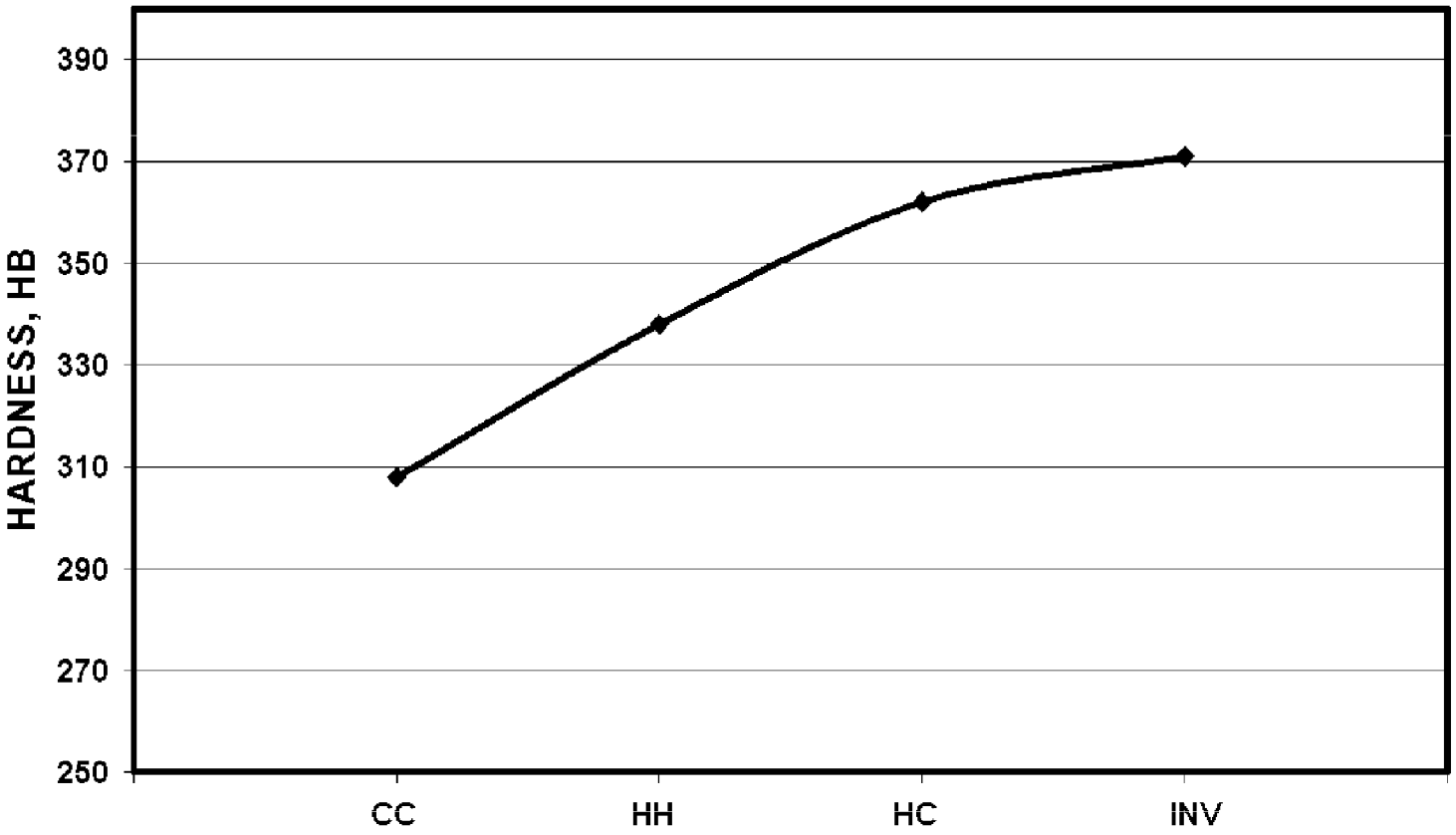
FIGS. 2*a* and 2*b* plot the average Brinell hardness of the four grades of crane rail discussed herein (CC, HH, HC and INV) at the top and center of the rail head, respectively.
Figure 2B:
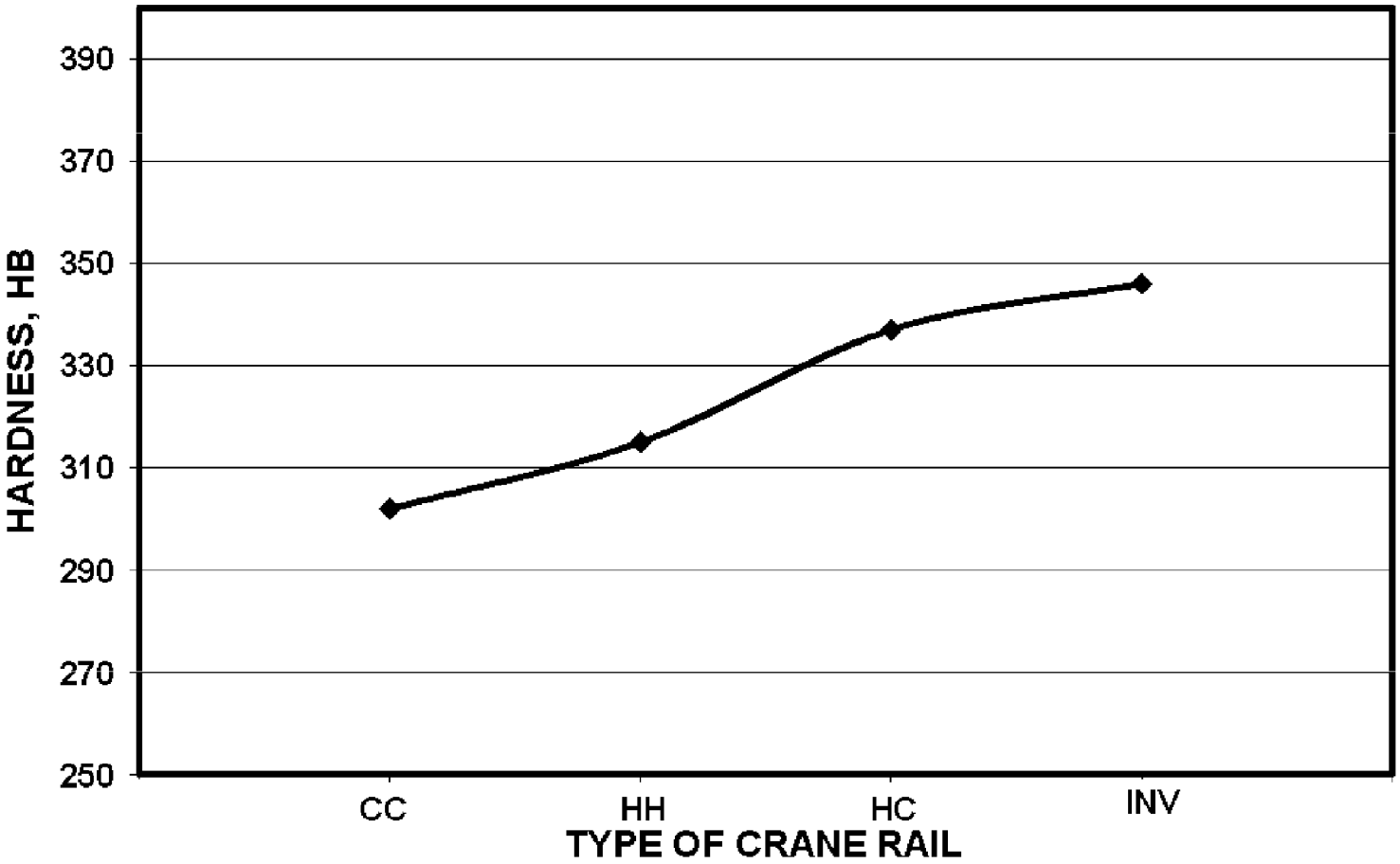

As can be seen, the hardness progressively increases from CC to HH to HC to INV at the top, side and center locations of the rail head. The plots shown in FIGS. 2*a* and 2*b* plot the average Brinell hardness of the four grades of crane rail discussed herein (CC, HH, HC and INV) at the top, and center of the rail head, respectively. The curves show the progression in hardness as the alloy content and process changes. The inventive rails having the inventive composition cooled by the inventive process are seen to have the highest hardness all around.

Strength properties: In addition to hardness, the tensile properties were measured in the rail head. A standard ASTM A370 tensile specimen with a ½" gauge diameter and 2" gauge length was machined from the top corner of the rail head. Table 6 shows the typical yield strength (YS), tensile strength (UTS), percent total elongation and percent reduction in area of the three conventional grades and the invention grade.

TABLE 6

| Type | YS ksi | UTS ksi | % Tot. Elong. | % Red. in Area |
|---|---|---|---|---|
| CC | 87 | 152 | 10.8 | 19.2 |
| HH | 105 | 168 | 11.3 | 23.8 |
| HC | 120 | 184 | 9.5 | 15.9 |
| INV | 124 | 187 | 10.8 | 21.6 |

As seen in the progression of hardness above, the strength also increases from grade to grade. It is interesting to note that the ductility (as represented by the % total elongation and % reduction in area) of the high carbon HC crane rail is lower than the other grades. This is because the steel is hypereutectoid and there is the potential of forming proeutectoid cementite networks on the prior austenite grain boundaries. These networks are known to lower ductility by providing an easy path for crack propagation. The invention grade, even at a similar elevated carbon level, has improved ductility. The higher silicon level helps minimize these networks. Also the vanadium addition acts to suppress the networks from forming on the austenite boundaries. Thus, the percent reduction in area (ductility) of the invention grade is 36% better than the HC grade at the same carbon level.

Generally, steelmaking may be performed in a temperature range sufficiently high to maintain the steel in a molten state. For example, the temperature may be in a range of about 1600° C. to about 1650° C. The alloying elements may be added to molten steel in any particular order, although it is desirable to arrange the addition sequence to protect certain elements such as titanium and vanadium from oxidation. According to one exemplary embodiment, manganese is added first as ferromanganese for deoxidizing the liquid steel. Next, silicon is added in the form of ferrosilicon for further deoxidizing the liquid steel. Carbon is then added, followed by chromium. Vanadium and titanium are added in the penultimate and final steps, respectively. After the alloying elements are added, the steel may be vacuum degassed to further remove oxygen and other potentially harmful gases, such as hydrogen.

Once degassed, the liquid steel may be cast into blooms (e.g., 370 mm×600 mm) in a three-strand continuous casting machine. The casting speed may be set at, for example, under 0.46 m/s. During casting, the liquid steel is protected from oxygen (air) by shrouding that involves ceramic tubes extending from the bottom of the ladle into the tundish (a holding vessel that distributes the molten steel into the three molds below) and the bottom of the tundish into each mold. The liquid steel may be electromagnetically stirred while in the casting mold to enhance homogenization and thus minimize alloy segregation.

After casting, the cast blooms are heated to about 1220° C. and rolled into a "rolled" bloom in a plurality (e.g., 15) of passes on a blooming mill. The rolled blooms are placed "hot" into a reheat furnace and re-heated to 1220° C. to provide a uniform rail rolling temperature. After descaling, the rolled bloom may be rolled into rail in multiple (e.g., 10) passes on a roughing mill, intermediate roughing mill and a finishing mill. The finishing temperature desirably is about 1040° C. The rolled rail may be descaled again above about 900° C. to obtain uniform secondary oxide on the rail prior to head hardening. The rail may be air cooled to about 800° C.-700° C.

Inventive Process: In order to achieve the higher hardness in the present invention, both composition and processing are essential. The crane rail is processed directly off the rail mill while it is still in the austenitic state. The titanium has already formed TiN particles that have restricted grain growth during heating. The rails are finish rolled at temperatures between 1040-1060° C. After leaving the last stand of the rail mill, the rails (while still austenitic) are sent to the head hardening machine. Starting at a surface temperature of between 750 and 800° C., the rail is passed through a series of water spray nozzles configured as shown in FIG. 3, which depicts a cross section of a crane rail and the water spray jets that are used to cool the crane rail.

Figure 3:
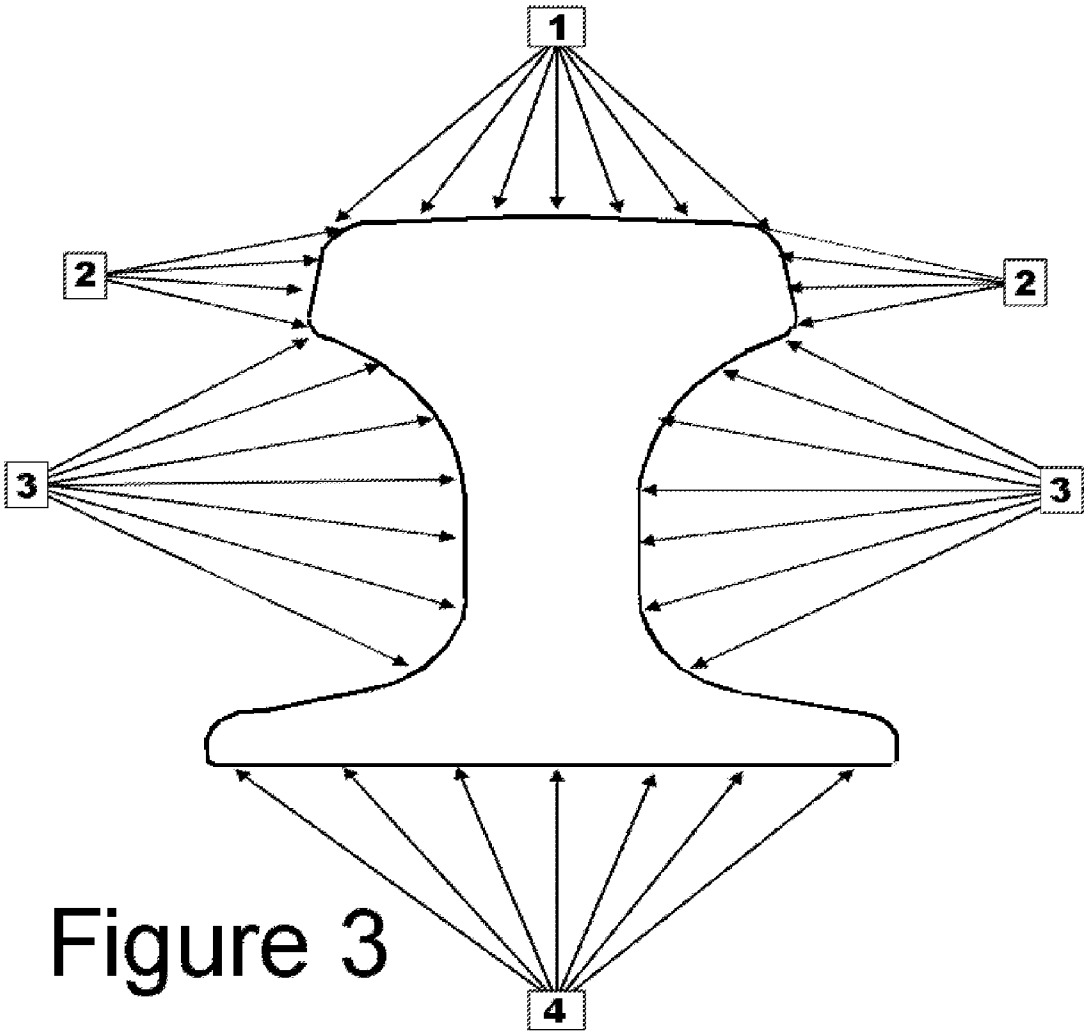
FIG. 3 depicts a cross section of a crane rail and the water spray jets that are used to cool the crane rail.

From FIG. 3, it may be seen that the water spray nozzle configuration includes a top head water spray 1, two side head water sprays 2, two web water sprays 3 and a foot water spray 4. The spray nozzles are distributed longitudinally in a cooling chamber that is 100 meters long and the chamber contains hundreds of cooling nozzles. The rail moves through the spray chamber at a speed of 0.5-1.0 meters/second. For property consistency, the water temperature is controlled within 10-16° C.

Figure 4:
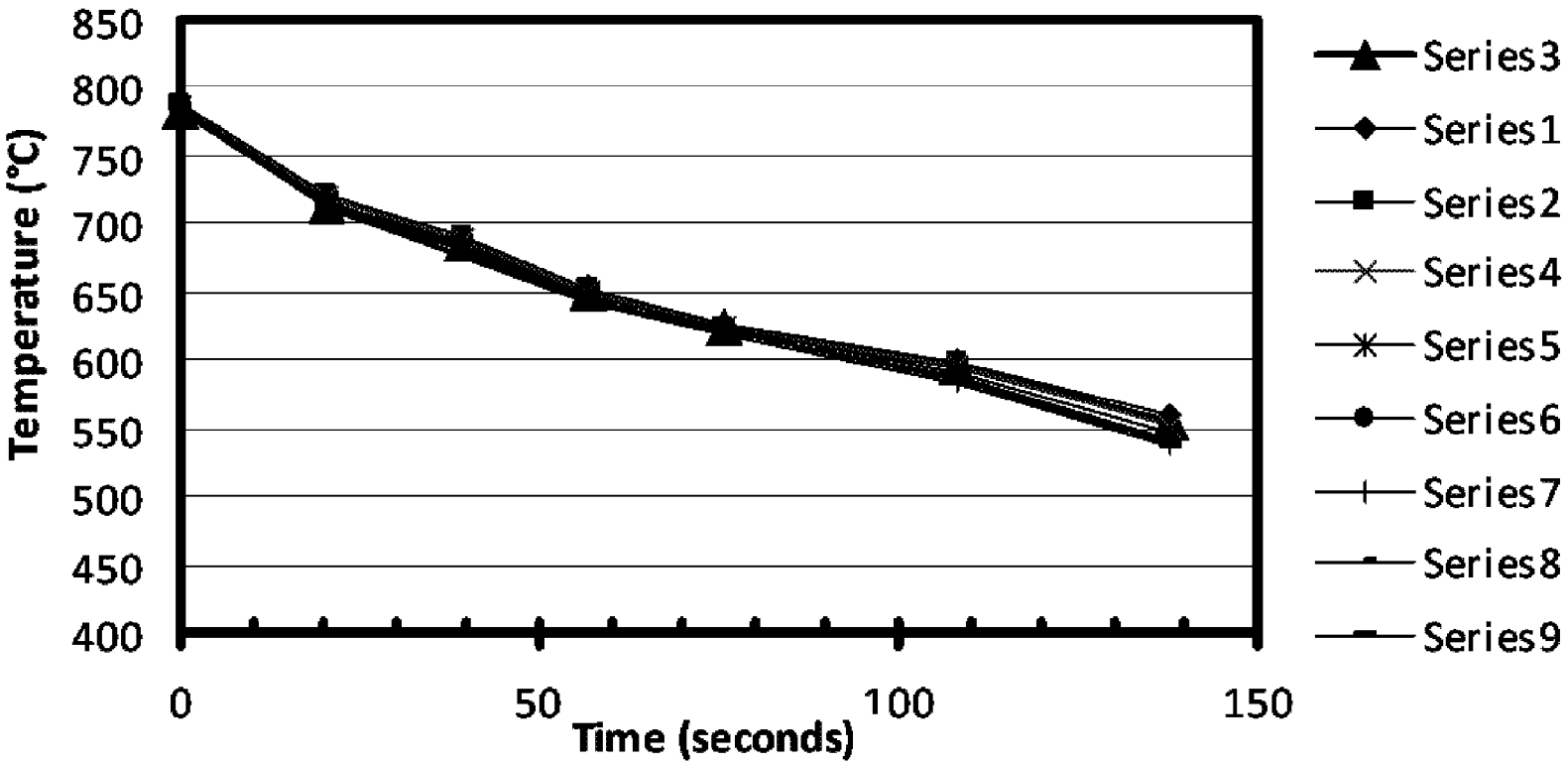
FIG. 4 plots the cooling curves (rail head temperature in ° C. vs the time since entering the first section of the chamber) of 9 rails of the present invention as they pass consecutively through the sections of the cooling chamber.

The water flow rate is controlled in four independent sections of the cooling chamber; each section being 25 meters long. For example, in processing the 175CR profile (175 lb/yd) shown above, the top and side head water flow rates are adjusted for each 25 meter section to achieve the proper cooling rate to attain a fine pearlitic microstructure in the rail head. FIG. 4 plots the cooling curves of 9 rails of the present invention as they pass consecutively through the sections of the chamber. Specifically, FIG. 4 plots the rail head temperature in ° C. vs the time since entering the first section of the chamber. Seven pyrometers (the temperature measurements of which are shown as the data points in FIG. 4) are located at key positions in each section. These pyrometers measure the top rail head surface temperature. The 7 top head pyrometers are located as follows:

Pyro 1: As the rail enters the cooling chamber—called the entry temperature;
Pyro 2: At a location half way through the 1st section;
Pyro 3: At the end of the 1st section;
Pyro 4: At a location half way through the 2nd section;
Pyro 5: At the end of the 2nd section;
Pyro 6: At the end of the 3rd section; and
Pyro 7: At the end of the 4th section.

Figure 5:
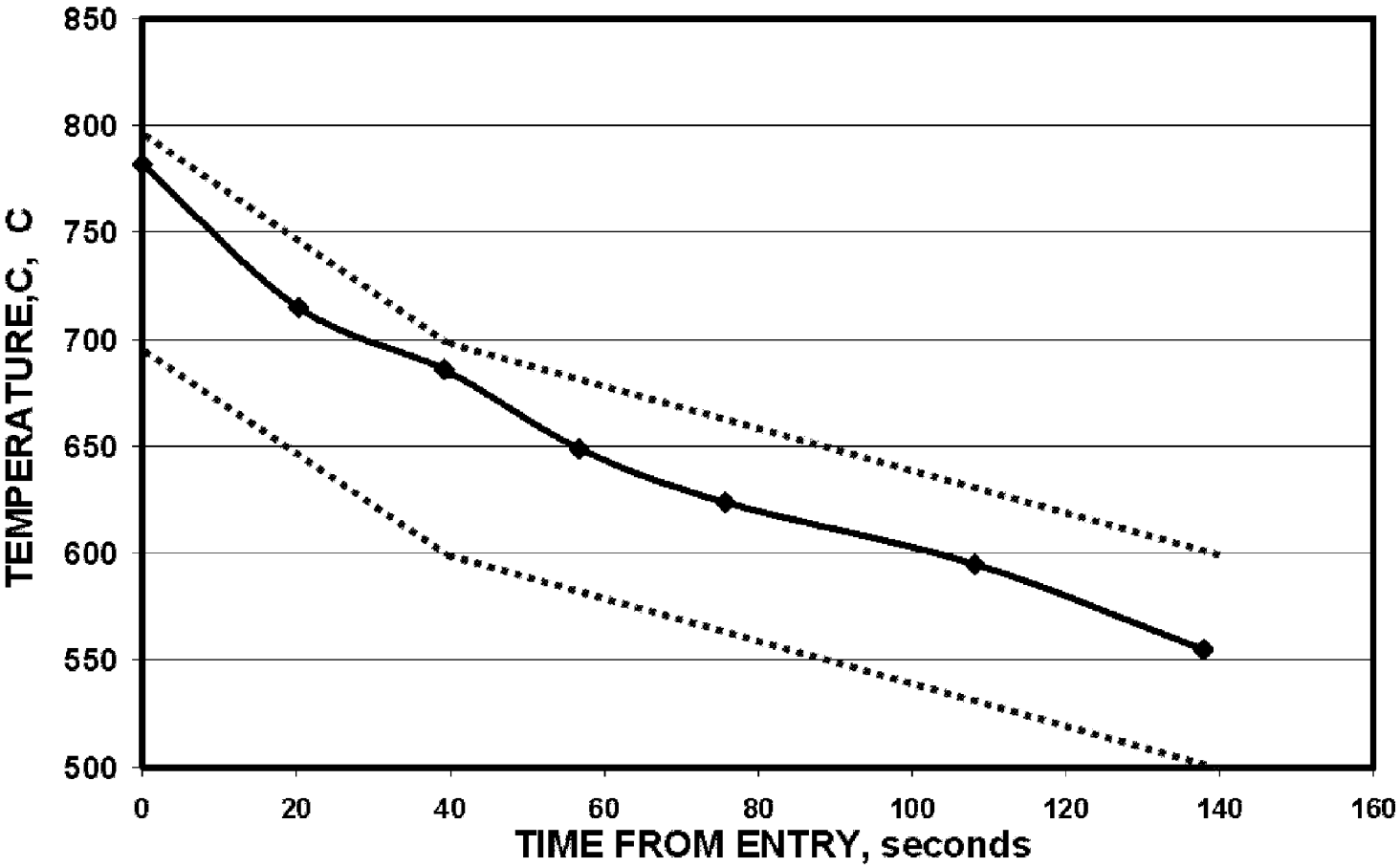
FIG. 5 plots the rail head temperature in ° C. vs the time since entering the first section of the chamber for a single rail, the dotted lines indicative of the top and bottom boundaries of the inventive cooling envelope.

An important part of the invention is controlling the cooling rate in the in four independent sections of the cooling chamber. This is accomplished by precise control of water flow in each section; particularly the total flow to the top and side head nozzles in each section. For the 9 rails of the present invention discussed above in relation to FIG. 4, the water flow amount to the top head nozzles in the first 25 meter section was 25 $m^3$/hr, 21 $m^3$/hr in the 2nd section, 9 $m^3$/hr in the 3rd section and 10 $m^3$/hr in the 4th section. After the rail exits the $4^{th}$ section, it is cooled by air cooling to ambient temperature. This partitioning of water flow influences the hardness level and the depth of hardness in the rail head. The cooling curve of the first of the 9 rails in FIG. 4 is plotted in FIG. 5 to show the result of water partitioning. Specifically FIG. 5 plots the rail head temperature in ° C. vs the time since entering the first section of the chamber for a single rail. The dotted lines indicate the top and bottom boundaries of the inventive cooling envelope.

The greatest amount of water is applied in the 1st section, which creates a cooling rate fast enough to suppress the formation of proeutectoid cementite and initiate the start of the pearlite transformation below 700° C. (between 600-700° C.). The lower the starting temperature of the pearlite transformation, the finer the pearlite interlamellar spacing and the higher the rail hardness. Once the crane rail head begins to transform to pearlite, heat is given off by the pearlite transformation—called the heat of transformation—and the cooling process slows dramatically unless the proper amount of water is applied. Actually the surface temperature can become hotter than before: this is known as recalescence. A controlled high level of water flow is required to take away this excess heat and allow the pearlite transformation to continue to take place below 700° C. The water flows in the 3rd and 4th sections continue to extract heat from the rail surface. This additional cooling is needed to obtain good depth of hardness.

As stated above, the dotted lines in FIG. 5 show the inventive cooling envelope and the two cooling regimes of the present invention. The first cooling regime of the cooling envelope spans from 0-40 seconds into the cooling chamber. In this regime of the cooling envelope the cooling curve is bounded by an upper cooling limit line and a lower cooling limit line (dotted lines in FIG. 5). The upper cooling line spans from time t=0 sec at a temperature of about 800° C. to t=40 sec and a temperature of about 700° C. The lower cooling line spans from time t=0 sec at a temperature of about 700° C. to t=40 sec and a temperature of about 600° C. The second cooling regime of the cooling envelope spans from 40 to 140 seconds into the cooling chamber. In this regime of the cooling envelope the cooling curve is again bounded by an upper cooling limit line and a lower cooling limit line (dotted lines in FIG. 5). The upper cooling line spans from time t=40 sec at a temperature of about 700° C. to t=140 sec and a temperature of about 600° C. The lower cooling line spans from time t=40 sec at a temperature of about 600° C. to t=140 sec and a temperature of about 500° C.

Within the two cooling regimes of the cooling envelope, the cooling rate is in two stages. In stage 1, which spans the first 20 seconds into the cooling chamber, the cooling rate is between about 2.25° C./sec and 5° C./sec down to a temperature of between about 730° C. and 680° C. Stage 2 spans from 20 second to 140 seconds in which the cooling rate is between 1° C./sec and 1.5° C./sec down to a temperature of between about 580° C. and 530° C. Thereafter the rails are air cooled to ambient temperature.

Unless stated otherwise, all percentages mentioned herein are by weight.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Although only a few embodiments have been disclosed in detail above, other embodiments are possible and the inventors intend these to be encompassed within this specification and the scope of the appended claims. The specification describes specific examples to accomplish a more general goal that may be accomplished in another way. Modifications and equivalents will be apparent to practitioners skilled in this art having reference to this specification, and are encompassed within the spirit and scope of the appended claims and their appropriate equivalents. This disclosure is intended to be exemplary, and the claims are intended to cover any modification or alternative which might be predictable to a person having ordinary skill in the art.

The invention claimed is:

1. A method of making a high strength head-hardened crane rail comprising the steps of:

providing a steel rail having a composition comprising, in weight percent:

| | |
|---|---|
| carbon | 0.79-1.00%; |
| manganese | 0.40-1.00; |
| silicon | 0.30-1.00; |
| chromium | 0.20-1.00; |
| vanadium | 0.05-0.35; |
| titanium | 0.01-0.035; |
| nitrogen | 0.002 to 0.0150; |

and the remainder being predominantly iron, said steel rail provided at a temperature between about 700 and 800° C.;

cooling said steel rail at a cooling rate that, if plotted on a graph with xy-coordinates with the x-axis representing cooling time in seconds and the y-axis representing temperature in ° C. of the surface of the head of the steel rail, is maintained in a region between an upper cooling rate boundary plot defined by an upper line connecting xy-coordinates (0 s, 800° C.), (40 s, 700° C.), and (140 s, 600° C.) and a lower cooling rate boundary plot defined by a lower line connecting xy-coordinates (0 s, 700° C.), (40 s, 600° C.), and (140 s, 500° C.);

wherein said step of cooling said steel rail comprises cooling said rail with water for 140 seconds.

2. The method of claim 1, wherein said composition comprises, in weight percent:

| | |
|---|---|
| carbon | 0.8-0.9; |
| manganese | 0.7-0.8; |
| silicon | 0.5-0.6; |
| chromium | 0.2-0.3; |
| vanadium | 0.05-0.1; |
| titanium | 0.02-0.03; |
| nitrogen | 0.008-0.01; |

and the remainder being predominantly iron.

3. The method of claim 2, wherein said crane rail has a head portion that has a fully pearlitic microstructure.

4. The method of claim 2, wherein said composition comprises, in weight percent:

carbon 0.87; manganese 0.76; silicon 0.54; chromium 0.24; vanadium 0.089; titanium 0.024; phosphorus 0.011; sulfur 0.006; nitrogen 0.009; and the remainder being predominantly iron.

5. The method of claim 4, wherein said crane rail has a head portion that has a fully pearlitic microstructure.

6. The method of claim 1, wherein said crane rail has a head portion that has a fully pearlitic microstructure.

7. The method of claim 1, wherein the head of said crane rail has an average Brinell hardness of at least 370 HB at a depth of ⅜ inches from the top center of said crane rail head; at least 370 HB at a depth of ⅜ inches from the sides of said crane rail head; and at least 340 HB at a depth of ¾ inches from the top center of said crane rail head.

8. The method of claim 7, wherein said crane rail has a yield strength of at least 120 ksi; an ultimate tensile strength of at least 180 ksi, a total elongation of at least 8% and a reduction in area of at least 20%.

9. The method of claim 7, wherein the cooling rate from 0 second to 20 seconds plotted on the graph has an average within a range of between about 2.25° C./sec and 5° C./sec, and wherein the cooling rate from 20 seconds to 140 seconds plotted on the graph has an average within a range of between about 1° C./sec and 1.5° C./sec.

10. The method of claim 1, wherein said step of providing a steel rail comprises the steps of:

forming a steel melt at a temperature of about 1600° C. to about 1650° C. by sequentially adding manganese, silicon, carbon, chromium, followed by titanium and vanadium, said titanium and vanadium may be added in any order or in combination to form the melt;

vacuum degassing said melt to further remove oxygen, hydrogen and other potentially harmful gases;

casting said melt into blooms;

heating the cast blooms to about 1220° C.;

rolling said bloom into a rolled bloom employing a plurality of passes on a blooming mill;

placing said rolled blooms into a reheat furnace;

re-heating said rolled blooms to 1220° C. to provide a uniform rail rolling temperature;

descaling said rolled bloom;

passing said rolled bloom sequentially through a roughing mill, intermediate roughing mill and a finishing mill to create a finished steel rail, said finishing mill having an output finishing temperature of 1040° C.;

descaling said finished steel rail above about 900° C. to obtain a uniform secondary oxide on said; and air cooling said finished rail to about 700° C.-800° C.

11. The method of claim 1, wherein said step of cooling said steel rail further comprises the step of cooling said rail in air to ambient temperature after said step of cooling said rail with water for 140 seconds.

12. The method of claim 1, wherein said step of cooling said steel rail with water comprises cooling said steel rail with spray jets of water.

13. The method of claim 12, wherein the water comprising said spray jets of water is maintained at a temperature of between 10-16° C.

14. The method of claim 12, wherein said step of cooling said steel rail with spray jets of water comprises directing said jets of water at the top of the rail head, the sides of the rail head, the sides of the rail web and the foot of the rail.

15. The method of claim 12, wherein said step of cooling said steel rail with spray jets of water comprises passing said steel rail through a cooling chamber which includes said spray jets of water.

16. The method of claim 15, wherein said cooling chamber comprises four sections and the water flow rate in each section is varied depending on the cooling requirement in each of the sections.

17. The method of claim 15, wherein greatest amount of water is applied in the first/inlet section of said cooling chamber, creating a cooling rate fast enough to suppress the formation of proeutectoid cementite and initiate the start of the pearlite transformation below 700° C.

18. The method of claim 17, wherein the water flow rate in the first/inlet section of the cooling chamber is 25 $m^3$/hr, the water flow rate in the second section of the cooling chamber is 21 $m^3$/hr, the water flow rate in the third section of the cooling chamber is 9 $m^3$/hr; and the water flow rate in the fourth/last section of the cooling chamber is 10 $m^3$/hr.

19. A method of making a high strength head-hardened crane rail comprising the steps of:

A) providing a steel rail having a composition comprising, in weight percent:

| | |
|---|---|
| carbon | 0.79-1.00%; |
| manganese | 0.40-1.00; |
| silicon | 0.30-1.00; |
| chromium | 0.20-1.00; |
| vanadium | 0.05-0.35; |
| titanium | 0.01-0.035; |
| nitrogen | 0.002 to 0.0150; |

and the remainder being predominantly iron, said steel rail provided at a temperature between about 700 and 800° C.; wherein said step of providing a steel rail comprises the steps of:

i) forming a steel melt at a temperature of about 1600° C. to about 1650° C. by sequentially adding manganese, silicon, carbon, chromium, followed by titanium and vanadium, said titanium and vanadium may be added in any order or in combination to form the melt;

ii) vacuum degassing said melt to further remove oxygen, hydrogen and other potentially harmful gases;

iii) casting said melt into blooms;

iv) heating the cast blooms to about 1220° C.;

v) rolling said bloom into a rolled bloom employing a plurality of passes on a blooming mill;

vi) placing said rolled blooms into a reheat furnace;

vii) re-heating said rolled blooms to 1220° C. to provide a uniform rail rolling temperature;

viii) descaling said rolled bloom;

ix) passing said rolled bloom sequentially through a roughing mill, intermediate roughing mill and a finishing mill to create a finished steel rail, said finishing mill having an output finishing temperature of 1040° C.;

x) descaling said finished steel rail above about 900° C. to obtain a uniform secondary oxide on said finished steel rail; and xi) air cooling said finished rail to about 700° C.-800° C.; and B) cooling said steel rail at a cooling rate that, if plotted on a graph with xy-coordinates with the x-axis representing cooling time in seconds and the y-axis representing temperature in ° C. of the surface of the head of the steel rail, is maintained in a region between an upper cooling rate boundary plot defined by an upper line connecting xy-coordinates (0 s, 800° C.), (40 s, 700° C.), and (140 s, 600° C.) and a lower cooling rate boundary plot defined by a lower line connecting xy-coordinates (0 s, 700° C.), (40 s, 600° C.), and (140 s, 500° C.).

* * * * *